US006886554B2

(12) United States Patent
Cheng

(10) Patent No.: US 6,886,554 B2
(45) Date of Patent: May 3, 2005

(54) FUME EXHAUST APPARATUS FOR COOKING STOVES

(76) Inventor: Shiang-Sheng Cheng, P.O. Box 90, Tainan City (TW)

( * ) Notice: Subject to any disclaimer, the term of this patent is extended or adjusted under 35 U.S.C. 154(b) by 0 days.

(21) Appl. No.: 10/661,611

(22) Filed: Sep. 15, 2003

(65) Prior Publication Data

US 2005/0056271 A1 Mar. 17, 2005

(51) Int. Cl.[7] ..... F24B 13/00
(52) U.S. Cl. ..... 126/299 D; 126/299 R; 454/56
(58) Field of Search ..... 126/299 D, 299 R; 454/56, 57, 58, 59, 60

(56) References Cited

U.S. PATENT DOCUMENTS 204,819 A * 6/1878 Harding ..... 126/301
245,689 A * 8/1881 Young ..... 126/301
286,643 A * 10/1883 Schwibinger ..... 126/301
368,231 A * 8/1887 Parks ..... 126/301
369,161 A * 8/1887 Carlson ..... 126/301
377,454 A * 2/1888 Hatch ..... 126/24
399,430 A * 3/1889 Neef ..... 126/301
1,375,548 A * 4/1921 Barnes ..... 126/301
4,612,909 A * 9/1986 Lee ..... 126/299 D
4,858,591 A * 8/1989 Fu ..... 126/299 D

* cited by examiner

*Primary Examiner*—Alfred Basichas

(57) ABSTRACT

A fume exhaust apparatus for cooking stoves includes a fixing base; a connection assembly pivotally mounted on the fixing base; a transparent hood assembled with a lower end of the connection assembly, and having a handle and a through hole; a fume-exhaust hose having one end connected to the through hole and the other end connected to a filter box and an air-suction motor; the air-suction motor connected with a control switch via a power-supply cord, and having one side connected with an air-exhaust tube. After the fixing base, the filter box and the air-suction motor are secured to a wall, the hood assembled in suspension can be moved to be positioned above a cooking vessel or directly covered on the cooking vessel, thereby efficiently exhausting fumes outdoors to keep the inside clean such that users can be relieved from the fumes to keep good health, very convenient in use.

2 Claims, 5 Drawing Sheets

FUME EXHAUST APPARATUS FOR COOKING STOVES

BACKGROUND OF THE INVENTION

1. Field of the Invention

This invention relates to a fume exhaust apparatus for cooking stoves, particularly to one having a fixing base; a connection assembly pivotally mounted on the fixing base; a transparent hood assembled with a lower end of the connection assembly, and having a heat-insulation handle and a through hole respectively disposed thereon; a fume-exhaust hose having one end connected to the through hole of the transparent hood and the other end connected to a filter box and an air-suction motor; and, the air-suction motor capable of being connected with a control switch via a power-supply cord, and having one side connected with an air-exhaust tube. After the fixing base, the filter box and the air-suction motor are respectively secured to a wall, the transparent hood is assembled with the connection assembly in suspension ready for use. The transparent hood can be freely moved to be positioned above a cooking vessel or directly covered on the cooking vessel to meet with users' individual needs, thereby efficiently exhausting fumes that are generated in cooking thoroughly out of a cooking environment to keep the inside clean such that users can be relieved from the suffering of the fumes to keep good health all the time, which is very convenient in use.

2. Description of the Prior Art

Generally speaking, a considerable amount of fumes are dispersed into the air in most household range or stove-top cooking so that the fumes with strong odor often fill the inside and are easily attached to the surfaces of the indoor walls, furniture and articles with difficulty in cleaning. It is known in many medical reports that such fumes are bad to human body and, even worse, liable to cause lung cancer after being contacted for a long time, thus bringing great damage in human health.

Therefore, many conventional fume exhausters are used in kitchens to exhaust fumes that are generated in cooking. However, most of the conventional fume exhausters are mounted in a stationary way on ambient walls of the kitchens at a predetermined distance above cooking stoves and cooking appliances so that it is impossible for users to freely adjust the height and position of the conventional fume exhausters to meet with their individual needs, thus greatly limiting the exhausting effect of the conventional fume exhausters without exhausting the fumes thoroughly out of a cooking environment.

SUMMARY OF THE INVENTION

The main purpose of the present invention is to offer a fume exhaust apparatus for cooking stoves, which can efficiently exhaust fumes that are generated in cooking thoroughly out of a cooking environment.

The primary feature of the present invention is to provide a fume exhaust apparatus for cooking stoves mainly including:

- a fixing base;
- a connection assembly pivotally mounted on the fixing base;
- a transparent hood assembled with a lower end of the connection assembly, and having a heat-insulation handle and a through hole respectively disposed thereon;

- a fume-exhaust hose having one end connected to the through hole of the transparent hood and the other end connected to a filter box and an air-suction motor; and,
- the air-suction motor capable of being connected with a control switch via a power-supply cord, and having one side connected with an air-exhaust tube.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
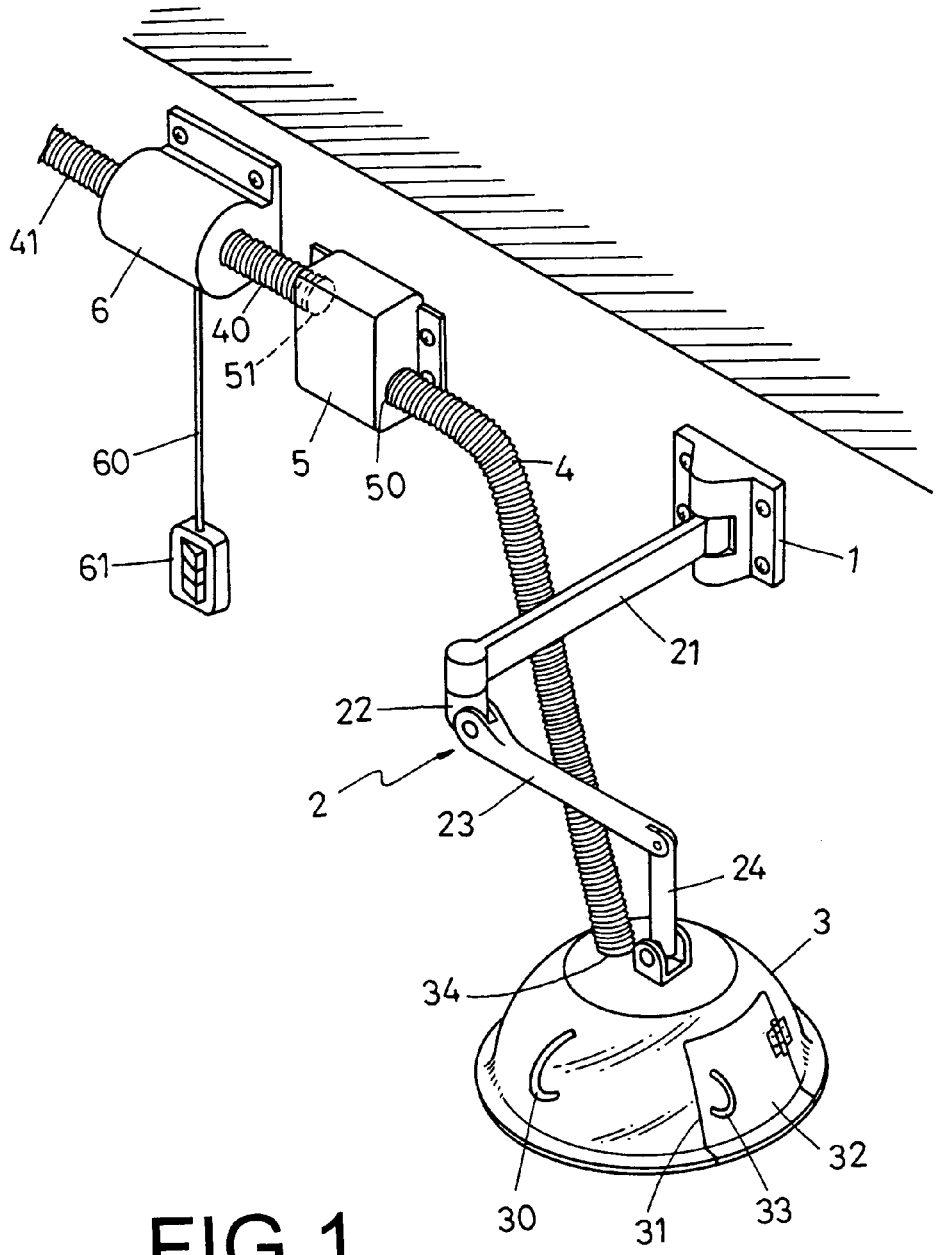
FIG. 1 is a perspective view of a fume exhaust apparatus for cooking stoves in the present invention.

A preferred embodiment of a fume exhaust apparatus for cooking stoves in the present invention, as shown in FIG. 1, mainly includes a fixing base 1, a connection assembly 2, a transparent hood 3, a fume-exhaust hose 4, a filter box 5 and an air-suction motor 6.

The connection assembly 2 pivotally mounted on the fixing base 1 includes a swivel arm 21 having one end pivotally mounted on the fixing base 1 and the other end provided with a swivel pivot 22 whose lower end is pivotally connected with one end of a connecting rod 23 whose the other end is pivotally connected with an upper end of a supporting rod 24.

The transparent hood 3 capable of being assembled with a lower end of the supporting rod 24 of the connection assembly 2 has a heat-insulation handle 30, an opening 31 and a through hole 34 respectively disposed thereon. The opening 31 is capable of being pivoted with a door 32 that is provided with a grip 33 disposed thereon.

The fume-exhaust hose 4 has one end connected to the through hole 34 of the transparent hood 3 and the other end connected to the filter box 5.

The filter box 5 is provided with an air inlet 50 disposed at one side thereof for connecting the other end of the fume-exhaust hose 4 and an air outlet 51 disposed at the other side thereof for connecting one end of an air-suction tube 40 whose the other end is connected with the air-suction motor 6.

The air-suction motor 6 capable of being connected with a control switch 61 via a power-supply cord 60 has one side connected with an air-exhaust tube 41 and the other side connected with the air-suction tube 40.

After the fixing base 1, the filter box 5 and the air-suction motor 6 are respectively secured to a wall, the transparent hood 3 is assembled with the connection assembly 2 in suspension ready for use.

Figure 2:
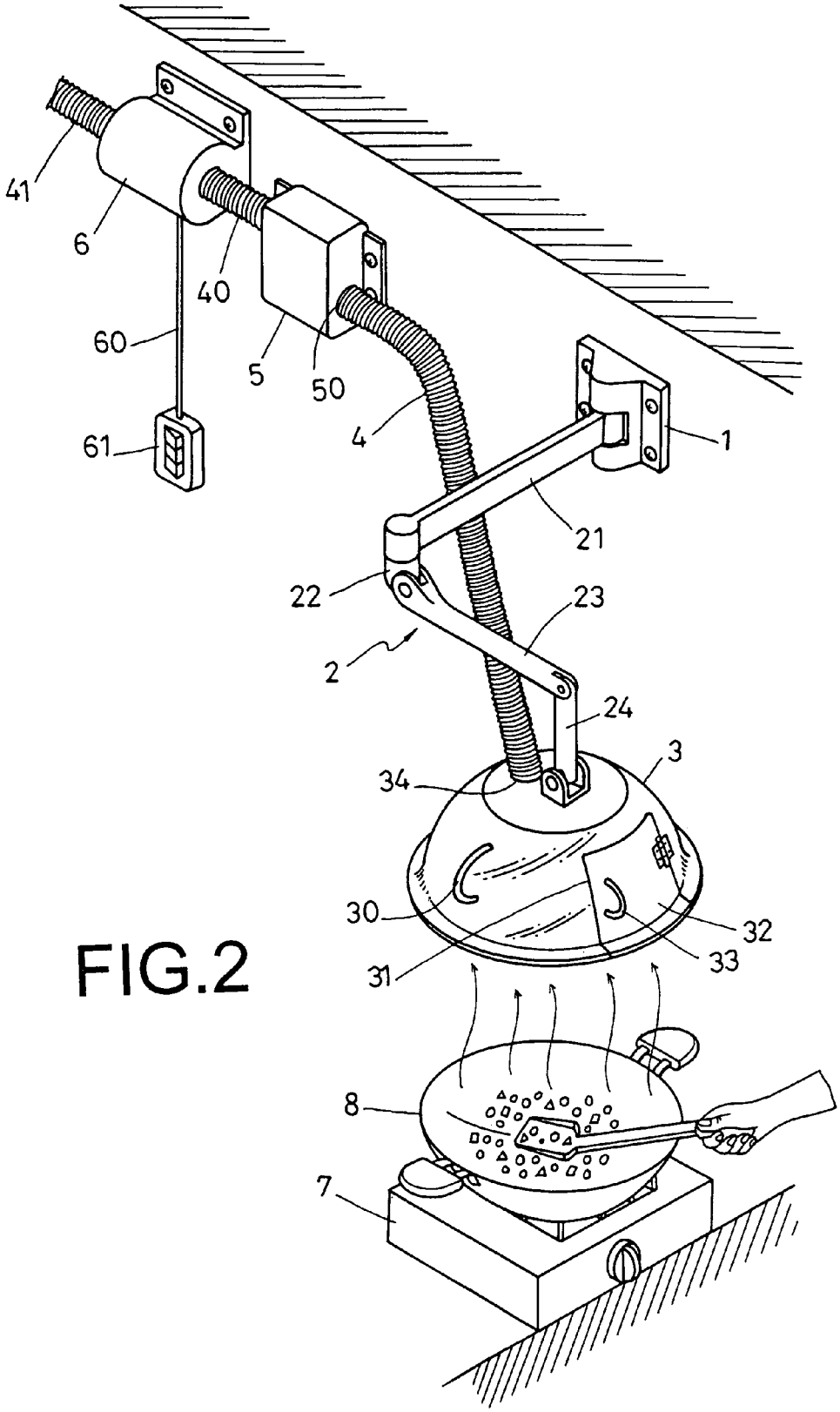
FIG. 2 is a schematic view of the fume exhaust apparatus for cooking stoves in the present invention, showing a hood positioned at a distance above a cooking vessel in cooking.

In using, referring to FIGS. 1 and 2, firstly a user can adjust the position of the transparent hood 3 to correspond the positions of a cooking stove 7 and a cooking vessel 8 only by holding the handle 30 of the transparent hood 3 with one hand to move the transparent hood 3. When the transparent hood 3 is moved, the connection assembly 2 is movable by having the swivel arm 21 swiveled around the fixing base 1 and the connecting rod 23 swiveled around the swivel pivot 22 in a position below the swivel arm 21. Moreover, by the pivotal connection with the swivel pivot 22, the connecting rod 23 is allowed to rotate upwards or downwards. In such way, the transparent hood 3 can be moved to any required positions, e.g. to be positioned at a proper distance above the cooking vessel 8, as shown in FIGS. 2, 3 and 4.

Secondly, when the user intends to cook the food, he only needs to depress the control switch 61 to actuate the air-suction motor 6 with a required air-exhaust speed so that fumes generated in cooking can be drawn from the transparent hood 3, through the fume-exhaust hose 4 and into the filter box 5 for filtering. And then, the filtered air can be exhausted outdoors via the air-exhaust tube 41. Moreover, the transparent hood 3 is able to be adjusted in its position at any distance above the cooking vessel 8, thereby enabling the fumes to be exhausted thoroughly out of a cooking environment.

Figure 3:
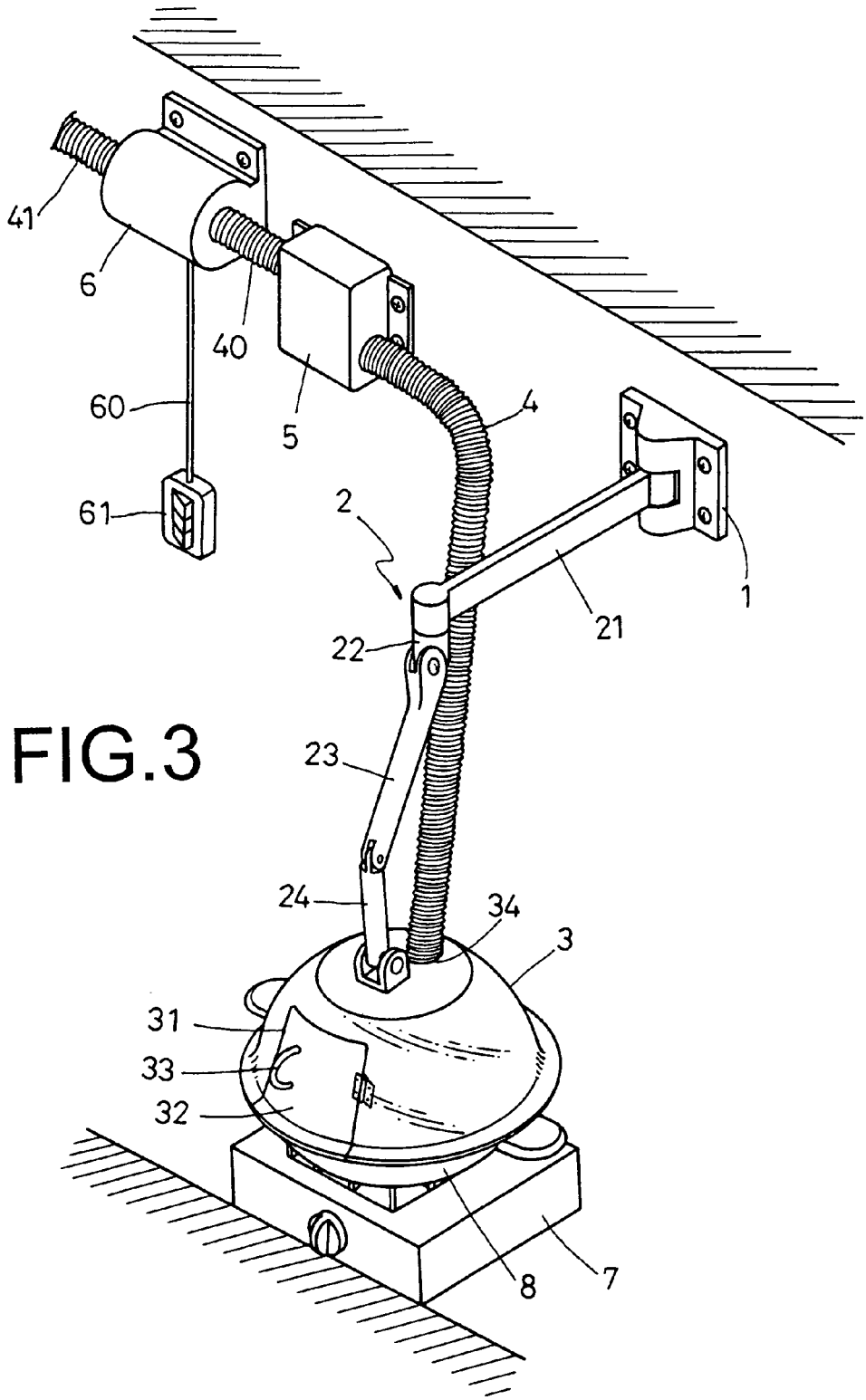
FIG. 3 is a schematic view of the fume exhaust apparatus for cooking stoves in the present invention, showing the hood directly covered on the cooking vessel in cooking while the cooking vessel and a cooking stove are placed at an angle different from those in FIG. 2.
Figure 4:
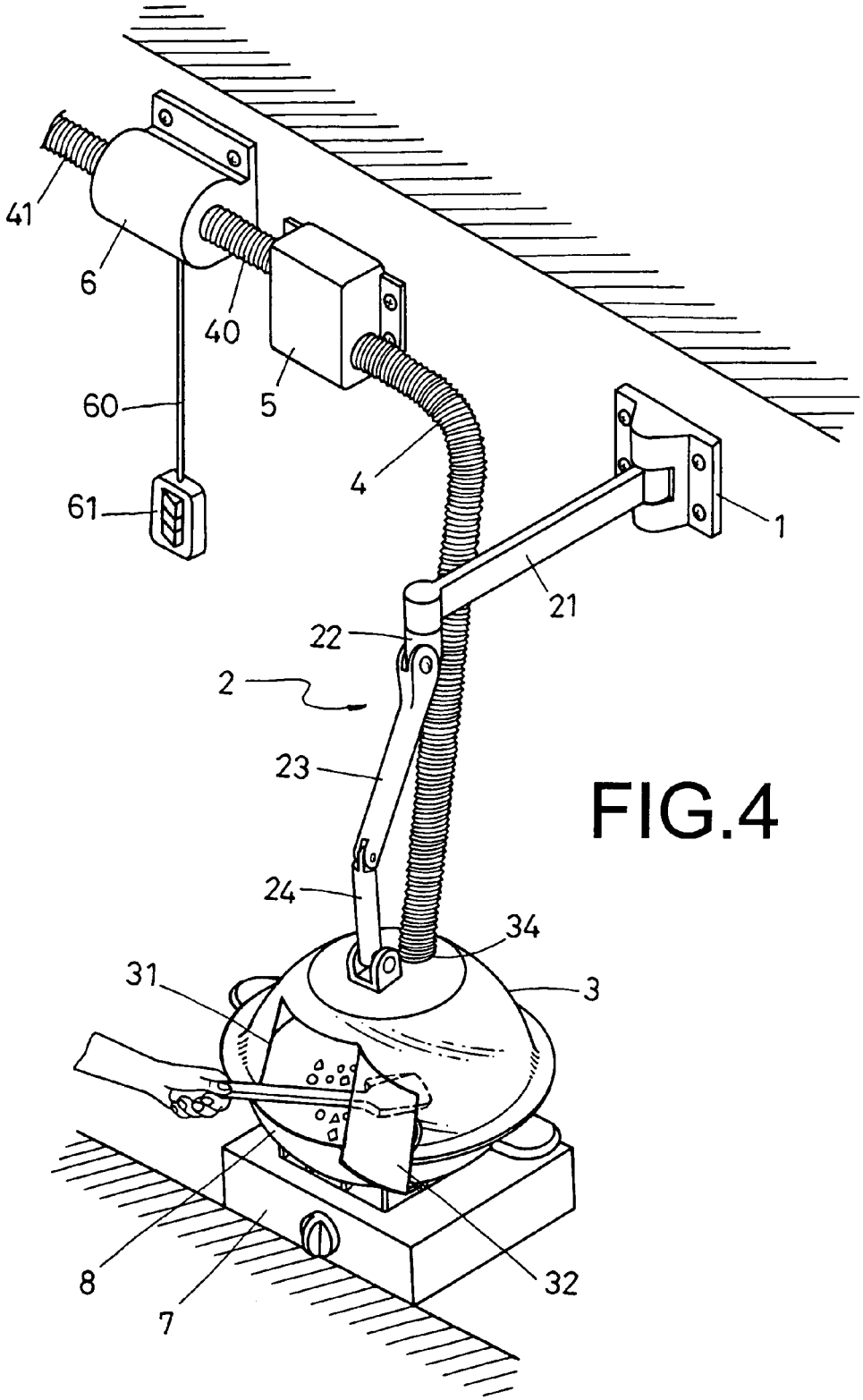
FIG. 4 is a schematic view of the fume exhaust apparatus for cooking stoves in the present invention, showing the hood directly covered on the cooking vessel in cooking and provided with a door in an open condition; and, FIG. 5 is a schematic view of the fume exhaust apparatus for cooking stoves in the present invention being in a collapsed condition.

Moreover, when the user intends to have the food or fishes pan-fried or deep-fried, he can move the transparent hood 3 downwards to be directly covered on the cooking vessel 8 to prevent hot oil that is generated in frying from being splashed out of the cooking vessel 8, and then make the fumes that are generated together with the hot oil directly drawn into the filter box 5 via the fume-exhaust hose 4 for filtering and exhausting, as shown in FIGS. 3 and 4.

Furthermore, a main body of the transparent hood 3 is designed to be transparent for the convenience of observing the cooking condition of the food from the outside of the cooking vessel 8. When the food is to be stirred, the user only needs to open the door 32 of the transparent hood 3 and extend a turner or a ladle (not numbered) into the cooking vessel 8 to stir the food, as shown in FIG. 4. In case that the user is hard to stir the food when the transparent hood 3 is covered on the cooking vessel 8, the user only needs to pull the transparent hood 3 upwards to be at a proper distance above the cooking vessel 8, which is very easy and simple in operation.

Figure 5:
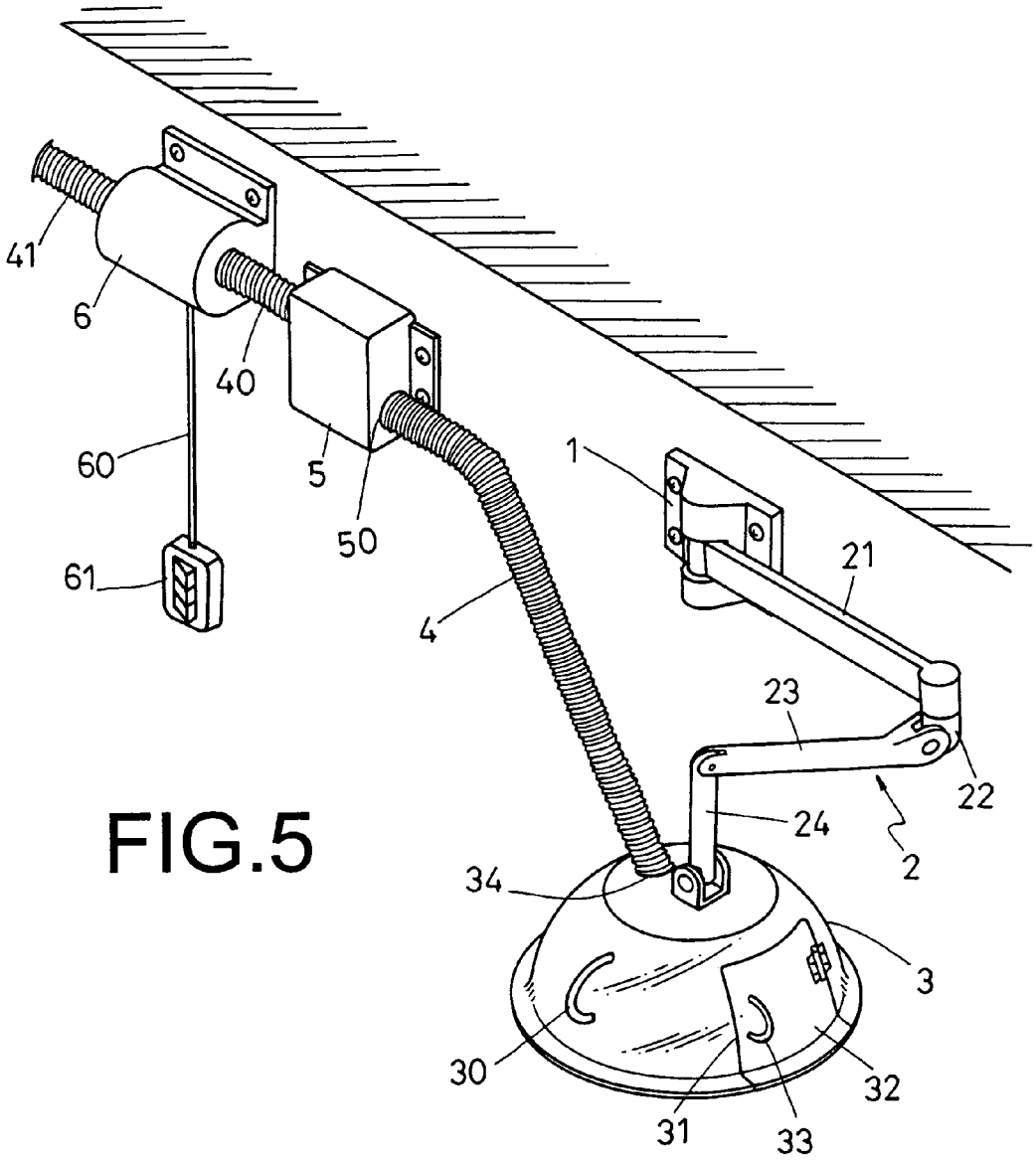

When the transparent hood 3 is not in use after the food is cooked, referring to FIG. 5, the user only needs to pull the transparent hood 3 upwards and push it against the wall, by which the swivel arm 21 will be swiveled to be attached to the wall and the connecting rod 23 can be rotated upwards accordingly so as to be close to the swivel arm 21, thereby allowing the transparent hood 3 to be deposited against the wall, thus enabling the fume exhaust apparatus of the present invention to be occupied only with little space, also very convenient in using and in collapsing.

The invention has the following advantages, as can be understood from the aforesaid description.

1. The fume exhaust apparatus of the present invention is simple in assemblage and convenient in operation. After the fume exhaust apparatus is installed on a wall in a position close to a cooking stove, the transparent hood 3 can be adjusted to move frontward, backward, upwards or downwards to any required positions for adapting to cooking stoves of various sizes and for using in different cooking ways.

2. The fume exhaust apparatus of the present invention can efficiently exhaust the fumes that are generated in cooking thoroughly out of a cooking environment to keep the inside clean such that users can be relieved from the suffering of the fumes to keep good health all the time.

3. When not in use, the transparent hood 3 of the present invention can be pulled upwards to be deposited against the wall for saving space.

While the preferred embodiment of the invention has been described above, it will be recognized and understood that various modifications may be made therein and the appended claims are intended to cover all such modifications that may fall within the spirit and scope of the invention.

What is claimed is:

1. A fume exhaust apparatus for cooking stoves, comprising:

a fixing base;

a connection assembly pivotally mounted on said fixing base;

a transparent hood assembled with a lower end of said connection assembly, and having a heat-insulation handle and a through hole respectively disposed thereon;

a fume-exhaust hose having one end connected to said through hole of said transparent hood and the other end connected to a filter box and an air-suction motor; and, said air-suction motor capable of being connected with a control switch via a power-supply cord, and having one side connected with an air-exhaust tube;

wherein said transparent hood has an opening disposed thereon for being pivoted with a door, said door provided with a grip disposed thereon.

2. A fume exhaust apparatus for cooking stoves, comprising:

a fixing base;

a connection assembly pivotally mounted on said fixing base;

a transparent hood assembled with a lower end of said connection assembly, and having a heat-insulation handle and a through hole respectively disposed thereon;

a fume-exhaust hose having one end connected to said through hole of said transparent hood and the other end connected to a filter box and an air-suction motor; and, said air-suction motor capable of being connected with a control switch via a power-supply cord, and having one side connected with an air-exhaust tube;

wherein said connection assembly comprises a swivel arm having one end pivotally mounted on said fixing base and the other end provided with a swivel pivot whose lower end is pivotally connected with one end of a connecting rod whose the other end is pivotally connected with an upper end of a supporting rod whose lower end is assembled with said transparent hood, whereby the arrangement of said connection assembly permits said transparent hood to be moved to any required positions.

* * * * *